United States Patent [19]

Griffith

[11] Patent Number: 4,497,615

[45] Date of Patent: Feb. 5, 1985

[54] SCROLL-TYPE MACHINE

[75] Inventor: Russell W. Griffith, Troy, Ohio

[73] Assignee: Copeland Corporation, Sidney, Ohio

[21] Appl. No.: 516,773

[22] Filed: Jul. 25, 1983

[51] Int. Cl.[3] ..... F04C 18/02; F04C 29/08

[52] U.S. Cl. ..... 417/310; 417/440; 418/55

[58] Field of Search ..... 417/310, 440; 418/55; 137/855; 251/333

[56] References Cited

U.S. PATENT DOCUMENTS

| | | | |
|---|---|---|---|
| 2,927,737 | 3/1960 | Zeuch et al. | 251/333 |
| 2,929,401 | 3/1960 | Cowan | 251/333 |
| 2,969,951 | 1/1961 | Walton | 251/333 |
| 4,129,405 | 12/1978 | McCullough | 418/55 |
| 4,383,805 | 5/1983 | Teegarden et al. . | |
| 4,389,171 | 6/1983 | Eber et al. | 418/55 |
| 4,432,708 | 2/1984 | Hiraga et al. . | |

FOREIGN PATENT DOCUMENTS 54-28002 3/1979 Japan .

*Primary Examiner*—Michael Koczo
*Assistant Examiner*—John J. McGlew, Jr.
*Attorney, Agent, or Firm*—Harness, Dickey & Pierce

[57] ABSTRACT

There is disclosed a scroll-type machine specifically suited for use as a gaseous fluid compressor. The machine has intermediate relief valve means providing variable pressure ratio characteristics to thereby improve efficiency, as well as protect against overcompression.

10 Claims, 10 Drawing Figures

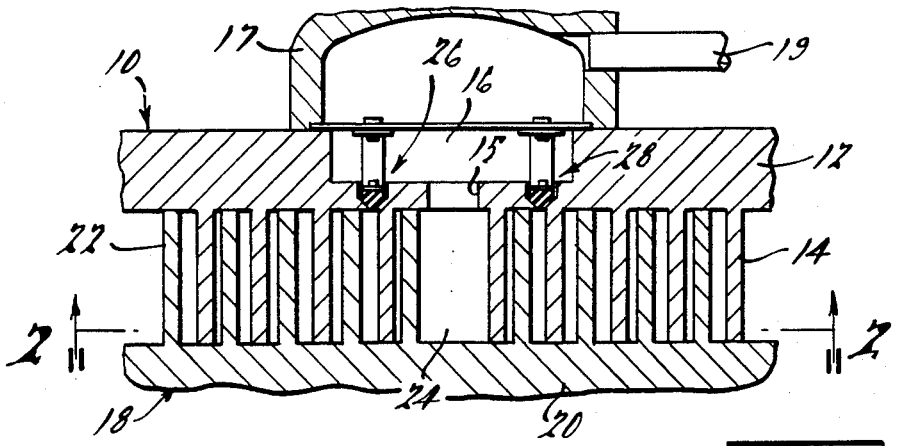
FIG. 1.
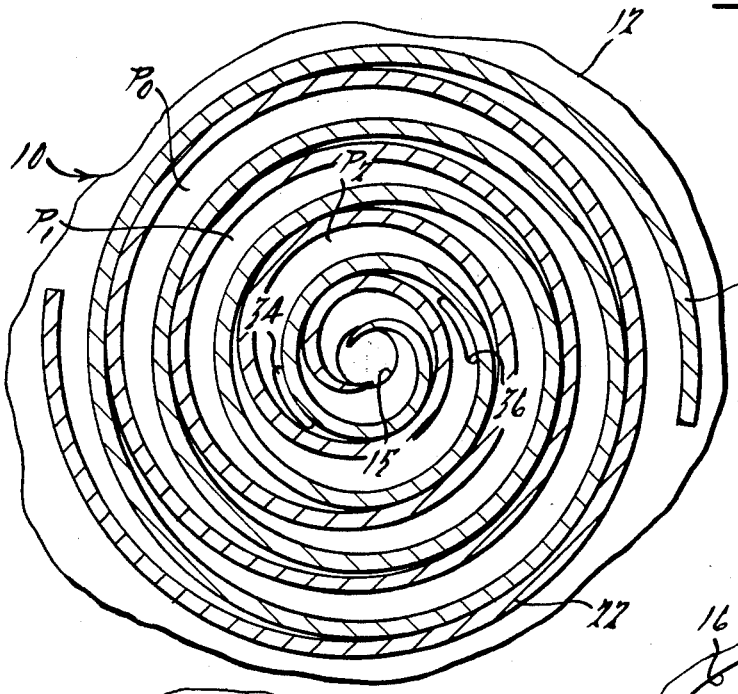
FIG. 2.
FIG. 3.
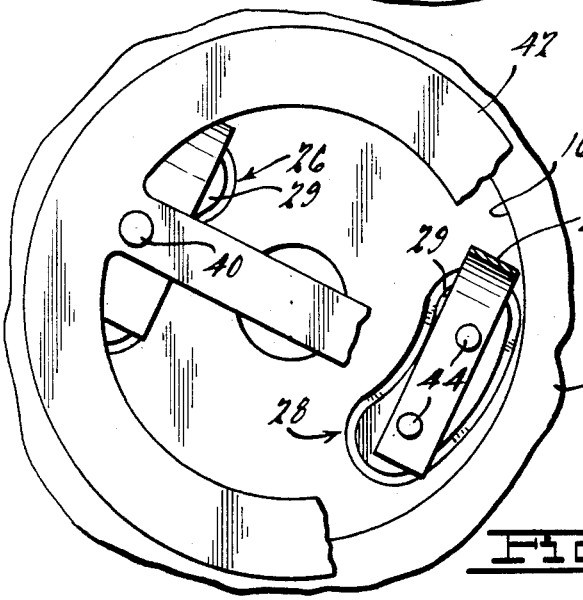
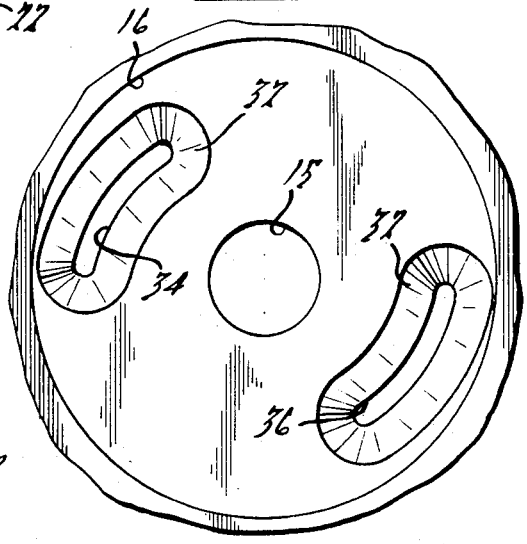
FIG. 4.

SCROLL-TYPE MACHINE

BACKGROUND AND SUMMARY

The present invention relates to fluid displacement apparatus and more particularly to a scroll-type machine especially adapted for compressing gaseous fluids and having intermediate relief valve means providing automatic variable pressure ratio characteristics to thereby improve efficiency, as well as protection against overcompression.

A class of machines exists in the art generally known as "scroll" apparatus for the displacement of various types of fluids. Such apparatus may be configured as an expander, a displacement engine, a pump, a compressor, etc. The present invention, however, is particularly applicable to compressors, and therefore for purposes of illustration is disclosed are in the form of a gaseous fluid compressor.

Generally speaking, a scroll apparatus comprises two spiral scroll wraps of similar configuration each mounted on a separate end plate to define a scroll member. The two scroll members are interfitted together with one of the scroll wraps being rotationally displaced 180 degrees from the other. The apparatus operates by orbiting one scroll member (the "orbiting" scroll member) with respect to the other scroll member (the "fixed" scroll member) to make moving line contacts between the flanks of the respective wraps defining moving isolated crescent-shaped pockets or chambers of fluid. The spirals are commonly formed as involutes of a circle, and ideally there is no relative rotation between the scroll members during operation, i.e., the motion is purely curvilinear translation (i.e. no rotation of any line in the body). The fluid pockets carry the fluid to be handled from a first zone in the scroll apparatus where a fluid inlet is provided, to a second zone in the apparatus where a fluid outlet is provided. The volume of a sealed pocket progressively changes as it moves from the first zone to the second zone. At any one instant in time there will be at least one pair of sealed pockets, and when there are several pairs of sealed pockets at one time, each pair will have different volumes. In a compressor the second zone is at a higher pressure than the first zone and is physically located centrally in the apparatus, the first zone being located at the outer periphery of the apparatus.

Generally, the greater the arcuate length of the scroll wrap the greater the possible total reduction in the volume of a pocket as it moves to the second zone (i.e. the greater the possible volume ratio); and the greater the volume ratio the greater the pressure ratio of the machine.

Two types of contacts define the fluid pockets formed between the scroll members: axially extending tangential line contacts between the spiral faces of the wraps caused by radial forces ("flank sealing"), and area contacts caused by axial forces between the plane edge surfaces (the "tips") of each wrap and the opposite end plate ("tip sealing"). For high efficiency, good sealing must be achieved for both types of contacts. In a conventional scroll compressor (i.e. one in which the wraps are involutes of a circle) good flank sealing requires that there be no relative rotation between the scrolls.

The concept of a scroll-type apparatus has been known for some time and has been recognized as having distinct advantages. For example, scroll machines have high isentropic and volumetric efficiency, and hence are relatively small and lightweight for a given capacity. They are quieter and more vibration free than many compressors because they do not use large reciprocating parts (e.g. pistons, connecting rods, etc.), and because all fluid flow is in one direction with simultaneous compression in plural opposed pockets there are less pressure-created vibrations. Such machines also tend to have high reliability and durability because of the relative few moving parts utilized, the relative low velocity of movement between the scrolls, and an inherent forgiveness to fluid contamination.

A scroll compressor is a positive displacement fixed volume-ratio machine; at the suction inlet a given volume of a gaseous fluid is sealed off and compressed to a final volume at which it is discharged. Because it has a fixed volume ratio, it also has a fixed pressure ratio. The pressure of the final compressed volume, and for that matter all intermediate volumes between initial seal-off and the final compressed volume, is determined substantially by two factors: (1) the pressure of the initial suction volume at seal-off, and (2) the volume reduction during compression. Thus, the pressure of the initial charge will rise to whatever pressure is dictated by the volume reduction during compression. This type of compression process can place severe limitations on the efficiencies, operating life, and actual pressure ratios attainable with the apparatus.

After a scroll compressor in a refrigerating system has been operating and then shut down, the pressure differential between the sealed-off pockets or chambers dissipates via leakage, heat transfer, etc. until the entire system becomes pressure equalized at a pressure somewhere between the suction and discharge pressure. Upon restartup, the equalization pressure, which is substantially higher than the suction pressure at which the compressor was designed to normally operate, becomes the initial suction pressure. During initial restartup, therefore, because the compressor has a fixed design pressure ratio, abnormally high chamber pressures can be developed. This condition can result in over-loaded bearings, over-stressed components, very high starting torque and even stalling of the machine. The high pressure condition is most severe at the beginning of restartup and diminishes as the suction pressure is "pulled down" to the normal operating suction pressure. For example, if a compressor has a 10:1 pressure ratio under design conditions, suction gas at 30 psi will be compressed to 300 psi. On the other hand, if the equalization pressure of the same system is 135 psi, then on start-up pressures in the magnitude of 1350 psi will be developed. In high pressure-ratio scroll compressors the problem is aggravated. Thus, the present invention is especially suited for use with high pressure-ratio machines such as that disclosed in my copending application entitled Scroll-Type Machine filed of even date.

Scroll compressors are designed to operate in a system having a design operating pressure or pressure range. The purpose of the compressor is to compress a gaseous fluid at suction pressure to the system operating pressure. Since the basic scroll compression process is a fixed pressure-ratio process, operation away from the design pressure ratio of the scroll results in compression inefficiencies. For example, if the scroll compressor is coupled with a system which is functioning at an operating pressure which is lower than the scroll compressor design pressure-ratio, the pressure in the final compressed volume just prior to discharge will be higher than the actual pressure in the system. Thus, on discharge the over-compressed gas will expand until the actual system pressure is reached, thereby causing inefficiency due to the work lost in over-compression.

It is therefore desirable to provide a means for reducing or eliminating over-compression when the system operating pressure is lower than the scroll compressor design pressure-ratio, thereby increasing compression efficiency. It is also desirable to provide a means to reduce or eliminate destructively high pressures which can occur upon restart-up.

Another advantage of the present invention is that it permits the design of a compressor having a greater than normal pressure ratio, for the purpose of avoiding those periods when system pressure exceeds the normal design pressure of the compressor, which would result in inefficient undercompression and reexpansion of the compressed gas.

The scroll-type apparatus of the present invention incorporates a pair of intermediate dump or pressure relief valves in either the fixed or orbiting scroll member which will automatically open the corresponding compression chamber to discharge plenum when the pressure in the chamber becomes greater than the system pressure seen by the discharge plenum, thereby stopping compression and dumping the gas to discharge. The valves are constructed of a lightweight material for quick action and good sealing, and are configured so that no reexpansion space is created in the fluid chambers, thereby maintaining efficiency. In this manner inefficient over-compression and excessively high pressures, along with the attendant bearing loads, starting torques, stresses, etc., are virtually eliminated, in simple and highly efficient manner.

Additional advantages and features of the present invention will become apparent from the subsequent description and the appended claims taken in conjunction with the accompanying drawings.

BRIEF DESCRIPTION OF THE DRAWINGS

FIG. 1 is a partial cross-section of the stationary and orbiting scroll members of a scroll apparatus embodying the present invention;

FIG. 2 is a cross-sectional view of the scroll apparatus of FIG. 1 taken along line 2—2 of FIG. 1;

FIG. 3 is a partial plan view of the non-wrap side of the fixed scroll member showing the location and configuration of the intermediate pressure relief valve ports of the present invention;

FIG. 4 is a partial plan view of the fixed scroll member of FIG. 3 with the pressure relief valves assembed in the valve ports (with the cylinder head removed);

DETAILED DESCRIPTION OF THE PREFERRED EMBODIMENT

Figure 5:
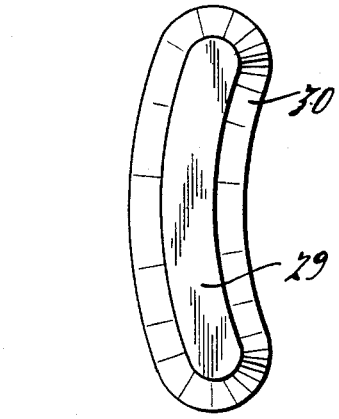
FIG. 5 is a bottom plan view of a pressure relief valve element of the present invention.
Figure 9:
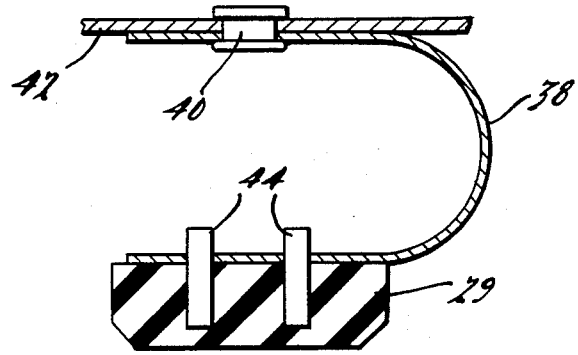
FIG. 9 is a reduced cross-sectional view of the pressure relief valve element and spring biasing means of FIG. 8 taken along line 9-of FIG. 8.
Figure 6:
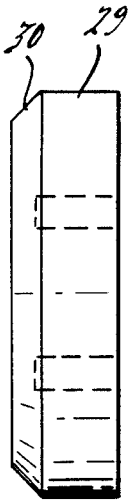
FIG. 6 is a top plan view of the pressure relief valve of FIG. 5.
Figure 7:
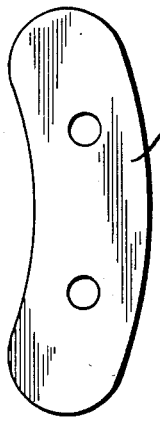
Figure 10:
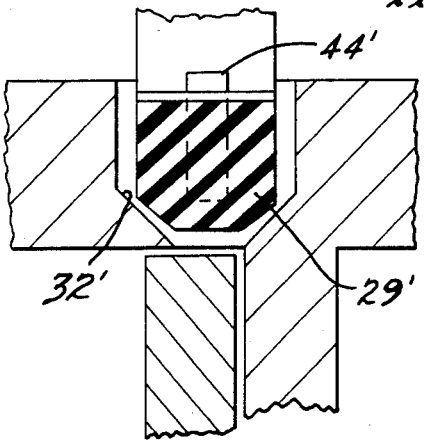

The basic structure and principles of the operation of scroll apparatus have been presented in a number of previously issued patents and therefore are well known to those skilled in the art. Consequently, a detailed description of the structure and operation of such apparatus will not be repeated in discussing the present invention.

It is necessary to bear in mind, however, that a scroll apparatus of the compressor type operates by moving sealed pockets or chambers of fluid from one region into another region while progressively decreasing the volume thereof. The sealed pockets of fluid are bounded by two parallel planes defined by end plates, and by two generally cylindrical surfaces, i.e., wrap flanks defined by the involute of a circle or other suitably curved configuration. The scroll members have parallel axes so that continuous sealing contact between the plane surfaces of the scroll members can be maintained. Movement of the pockets relative to the end plates is effected as one cylindrical surface (flank of the wrap of the orbiting scroll member) is orbited relative to the other cylindrical surface (flank of the wrap of the stationary scroll member). In the case of compressors the pressures in the moving pockets increase radially inwardly; thus, a pressure differential exists from one pocket to its radially adjacent pocket.

Referring now to the drawings, FIGS. 1 and 2 show a stationary scroll member 10 comprising an end plate 12, an involute wrap 14 and a centrally located fluid discharge port 15 communicating with a discharge plenum 16 enclosed by a cylinder head 17 to which the usual discharge line 19 is connected. FIGS. 1 and 2 also show an orbiting scroll member 18 comprising an end plate 20 and an involute wrap 22. In practice, the orbiting scroll member may be attached to a drive shaft (not shown) or caused to orbit through the use of any other suitable known drive mechanism. In typical operation, the orbiting scroll member 18 is driven to substantially described a circular orbit while the two scroll members are maintained in a substantially fixed angular relationship. During its orbiting motion, the orbiting scroll member defines one or more moving fluid pockets, i.e., pockets having the volume relationship $P_0 > P_1 > P_2$, as shown in FIG. 2. These pockets are bounded radially by sliding or moving the contacts between wraps 14 and 22. The fluid is taken through the usual suction line (not shown) into a peripheral zone surrounding the wraps, and from there is introduced into the pockets and compressed as the pockets approach the center of the machine, indicated at 24, from whence it is discharged through port 15 into plenum 16 and discharge line 19. Up to this point the construction and operation of the machine is conventional.

The intermediate dumping or relief valve of the present invention comprise two symmetrically located valves 26 and 28. Each valve comprises a kidney shaped (in plan) valve element 29 having a converging sealing surface 30 adapted to sealingly engage a similarly shaped valve seat 32 surrounding spaced valve ports 34 and 36, respectively. The non-round shape of the valves is to obtain adequate flow area in a compressor having a high aspect ratio (ratio of axial of radial chamber dimension). In compressors having relatively low aspect ratios and/or very thick wraps, it may be possible to use circular valve ports and seats.

Each valve element 29, which may be formed of a lightweight polymeric material such as "Vespel", a polyimide resin available from duPont Company, Wilmington, Del., is biased into a closed seated position by means of a generally U-shaped leaf spring 38, the upper end of which is mounted by means of a fastener 40 to a retainer 42 having the shape best shown in FIG. 4, the retainer being clamped in place between cylinder head 17 an scroll member 10. The lower end (as shown) of spring 38 urges valve element 29 into seated closed position. Relative motion between the spring and valve element is prevented by means of a pair of pins 44 affixed to the valve element and extending through holes in the end of the spring. Spring 38 is provided solely to guide the valve element and to insure its seating in the absence of a pressure differential thereacross (i.e., it is a "weak" spring). Normally the relief valves are held closed by discharge pressure in the discharge plenum. In this regard, valve elements formed of "Vespel" have been found to have excellent sealing characteristics. Because the bottom of each valve is substantially flush with the adjacent end plate surface there is not detrimental reexpansion volume created; the chamber is configured as if no valve is present (when in the closed condition).

Valves 26 and 28, which act as simple check valves, are symmetrically located with regard to the center of the scroll member approximately 180 degrees apart, and are positioned so that they are greater than one full wrap from the active outer end thereof (i.e., are positioned in communication with a chamber disposed downstream of full suction seal off, which normally occurs upon completion of the first 360 degrees of orbital movement).

Figure 8:
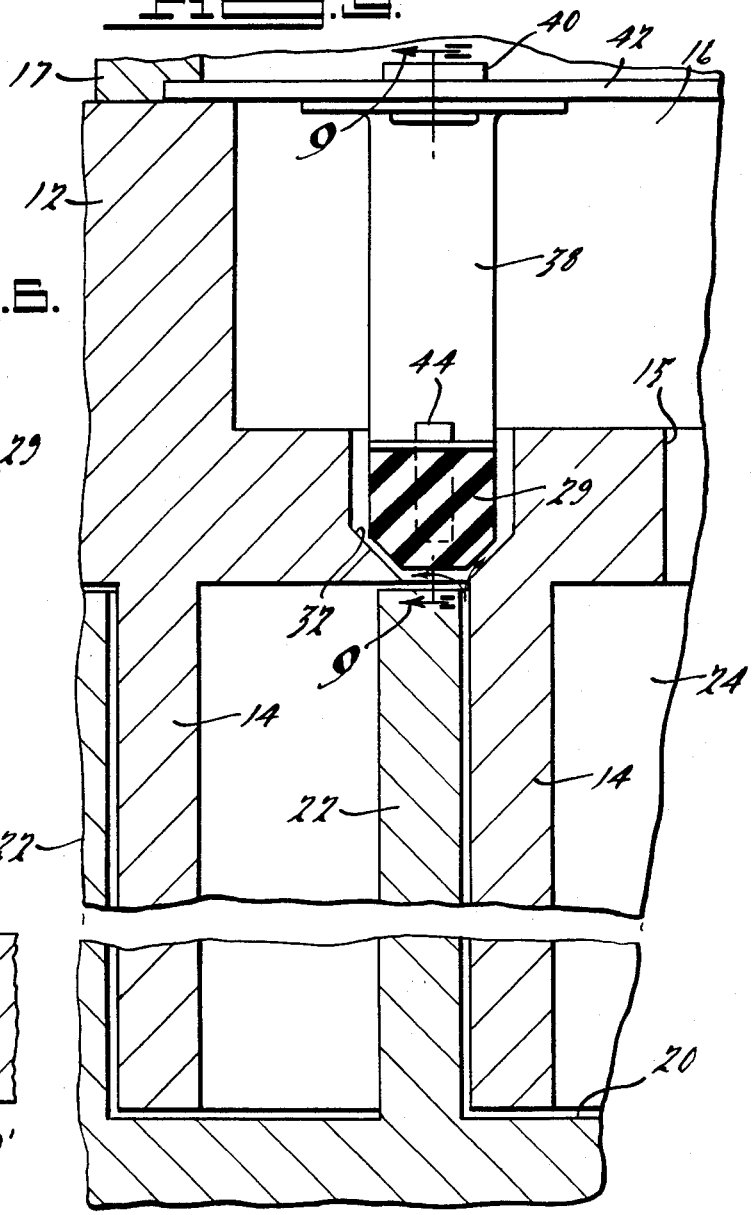
FIG. 8 is an enlarged cross-sectional view broken away, of the intermediate pressure relief valve of the preferred embodiment of the present invention, the various clearances in the machine being shown in a greatly exaggerated manner.

If the valves are located in the fixed scroll member (as they are in the disclosed embodiment), the valve ports should be located with one valve immediately adjacent the outer flank of the fixed scroll wrap defining the chamber controlled by that valves, and with the other valve immediately adjacent the inner flank of the fixed scroll wrap defining the chamber controlled by this valve. Furthermore, as best seen in FIGS. 2 and 8, the shape of each valve port should correspond with the shape of the adjacent flank, i.e. the long curve should theoretically have the same involute profile as the adjacent wrap flank, although a circular arc approximating this profile should be satisfactory. Also, the radial dimension of each port should be less than the thickness of the adjacent orbiting scroll wrap, as best seen in FIG. 8. This prevents each valve from relieving more than a single chamber at one time. The circumferential length of each port will be dictated by the port area required to accommodate the flow desired, but should not be so long as to permit a single valve to relieve more than one chamber at a time. The valve port length, as well as its locations along the wrap, determines the increase in pressure ratio range which can be achieved. The ports are preferably symmetrically located for balancing purposes.

The operation of a compressor incorporating the present invention is fully automatic and very straightforward. Whenever during operation the pressure in a valved chamber exceeds the system pressure seen by the discharge plenum gas is automatically discharged through valves 26 and 28 into the dicharge plenum without overcompression, as best shown in FIG. 8. Because the discharge plenum will normally never be at a dangerously excessive pressure, and because the pressure in the discharge plenum determines maximum discharged pressure, on start-up the compressor can easily dump to the plenum without reaching the destructive high pressures which might otherwise be created.

Although only one pair of valves is shown (one pair per wrap being theoretically sufficient), it should be appreciated that any number of pairs of valves may be provided in accordance with the above criteria. Conceivably, a compressor could have a valve for every wrap, which would extend the pressure ratio range of the machine from 1:1 all the way up to the maximum design pressure ratio (i.e. it would be an infinite ratio machine. Also, the valves can be located on either the fixed or the orbiting scroll member. In addition, valve having a sealing surface which tapers at a different angle than the valve seat, such as disclosed in U.S. Pat. No. 4,368,755 (the disclosure of which is incorporated herein by reference) may also be used.

Thus there is described and shown in the above description and in the drawings an improved scroll-type machine which fully and effectively accomplishes the objectives thereof. However, it will be apparent that variations and modifications of the disclosed embodiment may be made without departing from the principles of the invention of the scope of the appended claims.

We claim:

1. A scroll member suitable for constructing a scroll apparatus, comprising:

(a) an end plate having a generally flat sealing surface;

(b) a spiral wrap having a beginning and an end and being attached to said end plate and projecting outwardly from said sealing surface;

(c) a valve port extending through said end plate intermediate of said beginning and said end of said spiral wrap, said port being generally kidney shaped in plan, one edge of said port lying immediately adjacent said wrap and being similar in shape thereto in plan; and (d) a pressure responsive valve disposed in said valve port, said valve being generally kidney shaped in plane and substantially flush with said sealing surface.

2. A scroll member as claimed in claim 1, wherein the profiles of said one edge and said wrap are involutes of a circle.

3. A scroll member as claimed in claim 1, wherein the profile of said wrap is the involute of a circle and the profile of said one edge is a circular arc approximating said involute.

4. A scroll member as claimed in claim 1, wherein said port has an inwardly tapering valve set in cross-section and said valve has a correspondingly shaped sealing surface.

5. A scroll member as claimed in claim 4, wherein the included angle of taper of said valve is substantially identical to that of said valve seat.

6. A scroll member as claimed in claim 4, wherein the included angle of taper of said valve is greater than that of said valve seat.

7. A scroll member as claimed in claim 1, wherein said valve is formed of a polymeric material.

8. A scroll member as claimed in claim 1, wherein said valve is formed of a polyimide resin.

9. A scroll member as claimed in claim 1, further comprising a spring retainer, and a spring operatively disposed between said spring retainer and said valve for normally biasing said valve to a closed position.

10. A scroll member as claimed in claim 9, wherein said spring is a generally U-shaped leaf spring in elevation.

* * * * *

UNITED STATES PATENT AND TRADEMARK OFFICE

CERTIFICATE OF CORRECTION

PATENT NO. : 4,497,615

DATED : February 5, 1985

INVENTOR(S) : Russell W. Griffith

It is certified that error appears in the above-identified patent and that said Letters Patent is hereby corrected as shown below:

Column 3, line 25, after "to" insert -- the --.

Column 3, line 36, after "in" insert -- a --.

Column 3, line 54, "assembed" should be -- assembled --.

Column 4, line 42, "described" should be -- describe --.

Column 4, line 65, "of" (second occurrence) should be -- to --.

Column 5, line 9, "an" should be -- and --.

Column 5, line 10, after "into" insert -- its --.

UNITED STATES PATENT AND TRADEMARK OFFICE

CERTIFICATE OF CORRECTION

PATENT NO. : 4,497,615

DATED : February 5, 1985

INVENTOR(S) : Russell W. Griffith

It is certified that error appears in the above-identified patent and that said Letters Patent is hereby corrected as shown below:

Column 5, line 22, "not" should be -- no --.

Column 5, line 63, "dicharge" should be -- discharge --.

Column 5, lines 67 and 68, "discharged" should be -- discharge --.

Column 6, line 49, "set" should be -- seat --.

Signed and Sealed this

*Twenty-seventh* Day of *August 1985*

[SEAL]

*Attest:*

DONALD J. QUIGG

*Attesting Officer* *Acting Commissioner of Patents and Trademarks*